US010234133B2

(12) United States Patent
Hirsch et al.

(10) Patent No.: US 10,234,133 B2
(45) Date of Patent: Mar. 19, 2019

(54) SYSTEM AND METHOD FOR PREVENTION OF LED LIGHT SPILLAGE

(71) Applicant: BRAGI GmbH, München (DE)

(72) Inventors: Eric Christian Hirsch, Munich (DE); Karin Schlierenkämper, Munich (DE)

(73) Assignee: BRAGI GmbH, München (DE)

( * ) Notice: Subject to any disclaimer, the term of this patent is extended or adjusted under 35 U.S.C. 154(b) by 94 days.

(21) Appl. No.: 15/244,937

(22) Filed: Aug. 23, 2016

(65) Prior Publication Data

US 2017/0059152 A1 Mar. 2, 2017

Related U.S. Application Data

(60) Provisional application No. 62/211,729, filed on Aug. 29, 2015.

(51) Int. Cl.

| | |
|---|---|
| ***F21V 33/00*** | (2006.01) |
| ***F21V 19/00*** | (2006.01) |
| ***F21V 31/00*** | (2006.01) |
| ***H05B 37/02*** | (2006.01) |
| ***F21V 15/01*** | (2006.01) |

(Continued)

(52) U.S. Cl.

CPC ..... *F21V 33/0056* (2013.01); *F21V 15/01* (2013.01); *F21V 19/003* (2013.01); *F21V 31/00* (2013.01); *H04R 1/1041* (2013.01); *H05B 37/0227* (2013.01); *F21Y 2115/10* (2016.08); *H04R 1/1016* (2013.01); *H04R 1/1058* (2013.01); *H04R 2201/107* (2013.01)

(58) Field of Classification Search

CPC . F21V 33/0056; H04R 1/1016; H04R 1/1041; H04R 1/1058; H04R 2201/107; H05B 37/0227

USPC ..... 381/74

See application file for complete search history.

(56) References Cited

U.S. PATENT DOCUMENTS

| | | | |
|---|---|---|---|
| 3,934,100 | A | 1/1976 | Harada |
| 4,150,262 | A | 4/1979 | Ono |

(Continued)

FOREIGN PATENT DOCUMENTS

| | | | |
|---|---|---|---|
| EP | 1017252 | A2 | 7/2000 |
| GB | 2074817 | | 4/1981 |

(Continued)

OTHER PUBLICATIONS

Announcing the $3,333,333 Stretch Goal (Feb. 24, 2014).

(Continued)

*Primary Examiner* — Anh T Mai
*Assistant Examiner* — Michael Chiang
(74) *Attorney, Agent, or Firm* — Goodhue, Coleman & Owens, P.C.

(57) ABSTRACT

A method for designing an electronic device including at least one LED light source to reduce spillage of light from the at least one LED light source includes designing a housing, designing a printed circuit board for placement within the housing, positioning the at least one LED light source on the printed circuit board, and positioning a plurality of electronic components around the at least one LED light source on the printed circuit board to reduce spillage of the light from the at least one LED light source. The electronic device may be an in-ear device and the housing may be an ear piece housing.

6 Claims, 4 Drawing Sheets

(51) Int. Cl.
*H04R 1/10* (2006.01)
*F21Y 115/10* (2016.01)

(56) References Cited

U.S. PATENT DOCUMENTS

| | | | |
|---|---|---|---|
| 4,334,315 | A | 6/1982 | Ono et al. |
| 4,375,016 | A | 2/1983 | Harada |
| 4,588,867 | A | 5/1986 | Konomi |
| 4,654,883 | A | 3/1987 | Iwata |
| 4,682,180 | A | 7/1987 | Gans |
| 4,791,673 | A | 12/1988 | Schreiber |
| 4,865,044 | A | 9/1989 | Wallace et al. |
| 5,191,602 | A | 3/1993 | Regen et al. |
| 5,201,007 | A | 4/1993 | Ward et al. |
| 5,280,524 | A | 1/1994 | Norris |
| 5,295,193 | A | 3/1994 | Ono |
| 5,298,692 | A | 3/1994 | Ikeda et al. |
| 5,343,532 | A | 8/1994 | Shugart |
| 5,363,444 | A | 11/1994 | Norris |
| 5,497,339 | A | 3/1996 | Bernard |
| 5,606,621 | A | 2/1997 | Reiter et al. |
| 5,613,222 | A | 3/1997 | Guenther |
| 5,692,059 | A | 11/1997 | Kruger |
| 5,721,783 | A | 2/1998 | Anderson |
| 5,749,072 | A | 5/1998 | Mazurkiewicz et al. |
| 5,771,438 | A | 6/1998 | Palermo et al. |
| 5,802,167 | A | 9/1998 | Hong |
| 5,929,774 | A | 7/1999 | Charlton |
| 5,933,506 | A | 8/1999 | Aoki et al. |
| 5,949,896 | A | 9/1999 | Nageno et al. |
| 5,987,146 | A | 11/1999 | Pluvinage et al. |
| 6,021,207 | A | 2/2000 | Puthuff et al. |
| 6,054,989 | A | 4/2000 | Robertson et al. |
| 6,081,724 | A | 6/2000 | Wilson |
| 6,094,492 | A | 7/2000 | Boesen |
| 6,111,569 | A | 8/2000 | Brusky et al. |
| 6,112,103 | A | 8/2000 | Puthuff |
| 6,157,727 | A | 12/2000 | Rueda |
| 6,167,039 | A | 12/2000 | Karlsson et al. |
| 6,181,801 | B1 | 1/2001 | Puthuff et al. |
| 6,208,372 | B1 | 3/2001 | Barraclough |
| 6,275,789 | B1 | 8/2001 | Moser et al. |
| 6,339,754 | B1 | 1/2002 | Flanagan et al. |
| 6,408,081 | B1 | 6/2002 | Boesen |
| D464,039 | S | 10/2002 | Boesen |
| 6,470,893 | B1 | 10/2002 | Boesen |
| D468,299 | S | 1/2003 | Boesen |
| D468,300 | S | 1/2003 | Boesen |
| 6,542,721 | B2 | 4/2003 | Boesen |
| 6,560,468 | B1 | 5/2003 | Boesen |
| 6,654,721 | B2 | 11/2003 | Handelman |
| 6,664,713 | B2 | 12/2003 | Boesen |
| 6,694,180 | B1 | 2/2004 | Boesen |
| 6,718,043 | B1 | 4/2004 | Boesen |
| 6,738,485 | B1 | 5/2004 | Boesen |
| 6,748,095 | B1 | 6/2004 | Goss |
| 6,754,358 | B1 | 6/2004 | Boesen et al. |
| 6,784,873 | B1 | 8/2004 | Boesen et al. |
| 6,823,195 | B1 | 11/2004 | Boesen |
| 6,852,084 | B1 | 2/2005 | Boesen |
| 6,879,698 | B2 | 4/2005 | Boesen |
| 6,892,082 | B2 | 5/2005 | Boesen |
| 6,920,229 | B2 | 7/2005 | Boesen |
| 6,952,483 | B2 | 10/2005 | Boesen et al. |
| 6,987,986 | B2 | 1/2006 | Boesen |
| 7,136,282 | B1 | 11/2006 | Rebeske |
| 7,203,331 | B2 | 4/2007 | Boesen |
| 7,209,569 | B2 | 4/2007 | Boesen |
| 7,215,790 | B2 | 5/2007 | Boesen et al. |
| 7,463,902 | B2 | 12/2008 | Boesen |
| 7,508,411 | B2 | 3/2009 | Boesen |
| 7,983,628 | B2 | 7/2011 | Boesen |
| 8,140,357 | B1 | 3/2012 | Boesen |
| 2001/0005197 | A1 | 6/2001 | Mishra et al. |
| 2001/0027121 | A1 | 10/2001 | Boesen |
| 2001/0056350 | A1 | 12/2001 | Calderone et al. |
| 2002/0002413 | A1 | 1/2002 | Tokue |
| 2002/0007510 | A1 | 1/2002 | Mann |
| 2002/0010590 | A1 | 1/2002 | Lee |
| 2002/0030637 | A1 | 3/2002 | Mann |
| 2002/0046035 | A1 | 4/2002 | Kitahara et al. |
| 2002/0057810 | A1 | 5/2002 | Boesen |
| 2002/0076073 | A1 | 6/2002 | Taenzer et al. |
| 2002/0118852 | A1 | 8/2002 | Boesen |
| 2003/0065504 | A1 | 4/2003 | Kraemer et al. |
| 2003/0100331 | A1 | 5/2003 | Dress et al. |
| 2003/0104806 | A1 | 6/2003 | Ruef et al. |
| 2003/0115068 | A1 | 6/2003 | Boesen |
| 2003/0125096 | A1 | 7/2003 | Boesen |
| 2003/0218064 | A1 | 11/2003 | Conner et al. |
| 2004/0070564 | A1 | 4/2004 | Dawson et al. |
| 2004/0160511 | A1 | 8/2004 | Boesen |
| 2005/0043056 | A1 | 2/2005 | Boesen |
| 2005/0125320 | A1 | 6/2005 | Boesen |
| 2005/0148883 | A1 | 7/2005 | Boesen |
| 2005/0165663 | A1 | 7/2005 | Razumov |
| 2005/0196009 | A1 | 9/2005 | Boesen |
| 2005/0251455 | A1 | 11/2005 | Boesen |
| 2005/0266876 | A1 | 12/2005 | Boesen |
| 2006/0029246 | A1 | 2/2006 | Boesen |
| 2006/0074671 | A1 | 4/2006 | Farmaner et al. |
| 2006/0074808 | A1 | 4/2006 | Boesen |
| 2007/0047740 | A1* | 3/2007 | Andrea ..... H04R 1/1041 381/74 |
| 2007/0067054 | A1* | 3/2007 | Danish ..... A47G 33/008 700/94 |
| 2008/0044002 | A1* | 2/2008 | Bevirt ..... H04M 1/05 379/430 |
| 2008/0084683 | A1* | 4/2008 | Takami ..... A61B 1/0669 362/23.16 |
| 2008/0146890 | A1* | 6/2008 | LeBoeuf ..... A61B 5/0059 600/300 |
| 2008/0254780 | A1 | 10/2008 | Kuhl et al. |

FOREIGN PATENT DOCUMENTS

| | | | |
|---|---|---|---|
| JP | 06292195 | | 10/1998 |
| WO | 2014043179 | A2 | 3/2014 |
| WO | 2015110577 | A1 | 7/2015 |
| WO | 2015110587 | A1 | 7/2015 |

OTHER PUBLICATIONS

BRAGI is on Facebook (2014).
BRAGI Update—Arrival of Prototype Chassis Parts—More People—Awesomeness (May 13, 2014).
BRAGI Update—Chinese New Year, Design Verification, Charging Case, More People, Timeline(Mar. 6, 2015).
BRAGI Update—First Sleeves From Prototype Tool—Software Development Kit (Jun. 5, 2014).
BRAGI Update—Let's Get Ready to Rumble, A Lot to Be Done Over Christmas (Dec. 22, 2014).
BRAGI Update—Memories From April—Update on Progress (Sep. 16, 2014).
BRAGI Update—Memories from May—Update on Progress—Sweet (Oct. 13, 2014).
BRAGI Update—Memories From One Month Before Kickstarter—Update on Progress (Jul. 10, 2014).
BRAGI Update—Memories From the First Month of Kickstarter—Update on Progress (Aug. 1, 2014).
BRAGI Update—Memories From the Second Month of Kickstarter—Update on Progress (Aug. 22, 2014).
BRAGI Update—New People @BRAGI-Prototypes (Jun. 26, 2014).
BRAGI Update—Office Tour, Tour to China, Tour to CES (Dec. 11, 2014).
BRAGI Update—Status on Wireless, Bits and Pieces, Testing-Oh Yeah, Timeline(Apr. 24, 2015).
BRAGI Update—The App Preview, The Charger, The SDK, Bragi Funding and Chinese New Year (Feb. 11, 2015).
BRAGI Update—What We Did Over Christmas, Las Vegas & CES (Jan. 19, 2014).

(56) References Cited

OTHER PUBLICATIONS

BRAGI Update—Years of Development, Moments of Utter Joy and Finishing What We Started(Jun. 5, 2015).
BRAGI Update—Alpha 5 and Back to China, Backer Day, On Track(May 16, 2015).
BRAGI Update—Beta2 Production and Factory Line(Aug. 20, 2015).
BRAGI Update—Certifications, Production, Ramping Up (Nov. 13, 2015).
BRAGI Update—Developer Units Shipping and Status(Oct. 5, 2015).
BRAGI Update—Developer Units Started Shipping and Status (Oct. 19, 2015).
BRAGI Update—Developer Units, Investment, Story and Status(Nov. 2, 2015).
BRAGI Update—Getting Close(Aug. 6, 2014).
BRAGI Update—On Track, Design Verification, How It Works and What's Next(Jul. 15, 2015).
BRAGI Update—On Track, on Track and Gems Overview (Jun. 24, 2015).
BRAGI Update—Status on Wireless, Supply, Timeline and Open House@BRAGI(Apr. 1, 2015).
BRAGI Update—Unpacking Video, Reviews on Audio Perform and Boy Are We Getting Close(Sep. 10, 2015).
Last Push Before the Kickstarter Campaign Ends on Monday 4pm CET (Mar. 28, 2014).
Staab, Wayne 1, et al., "A One-Size Disposable Hearing Aid is Introduced", The Hearing Journal 53(4):36-41) Apr. 2000.
Stretchgoal—It's Your Dash (Feb. 14, 2014).
Stretchgoal—The Carrying Case for the Dash (Feb. 12, 2014).
Stretchgoal—Windows Phone Support (Feb. 17, 2014).
The Dash + The Charging Case & The BRAGI News (Feb. 21, 2014).
The Dash—A Word From Our Software, Mechanical and Acoustics Team + An Update (Mar. 11, 2014).
Update From BRAGI—$3,000,000—Yipee (Mar. 22, 2014).

* cited by examiner

SYSTEM AND METHOD FOR PREVENTION OF LED LIGHT SPILLAGE

PRIORITY STATEMENT

This application claims priority to U.S. Provisional Patent Application No. 62/211,729 hereby incorporated by reference in its entirety.

FIELD OF THE INVENTION

The present invention relates to wearable devices which include light emitting diodes (LEDs). More particularly, but not exclusively, the present mention relates to in ear headphones.

BACKGROUND OF THE ART

In ear headphones are spatially limited by the size of the user's external auditory canal and pima. Given such limitations, monitoring sensors are necessarily space limited as well. At the same time, however, such systems are required for proper device function. One such example is a device requiring at least one LED light source. Emissions of the LED introduce varying levels of light spillage. Such levels of light spillage in significantly confined structures are problematic by introducing unacceptably high levels of artifact. These artifacts may produce false negative or false positive results. Various methods have been suggested to limit this side spillage of the generated light. These include the use of expensive LEDs with coned apertures. Such apertures limit the effective amount of side spillage. These have the disadvantage of much greater size and cost. Another method of controlling side spillage is through the use of baffles or shields. These systems have the disadvantage of increasing both the size and the bulk of the device. What is needed is a new way to prevent light spillage from LED light sources.

SUMMARY

Therefore, it is to primary object, feature, or advantage to improve over the state of the art.

It is a further object, feature, or advantage to prevent light spillage from LED light sources.

A still further object, feature, or advantage of the present invention is to provide for preventing light spillage in a manner that is not cost prohibitive and is commercially viable.

Another object, feature, or advantage of the present invention is to provide for a reduction of weight of a device.

Yet another object, feature, or advantage of the present invention provides for the prevention of the necessity of utilization of expensive LED light sources.

A further object, feature, or advantage of the present invention is to minimize the required footprint of available LED light sources.

A still further object, feature, or advantage of the present invention is to allow for maximal use of all required electronic componentry.

Another object, feature, or advantage is to minimize the weight of the device required for device construction.

Yet another object, feature, or advantage is to minimize the number of components required for device construction.

A further object, feature, or advantage of the present invention is to simplify the device construction through minimizing the number of required components.

One or more of these and/or other objects, features, or advantages of the present invention will become apparent from the specification and claims that follow. No single embodiment need exhibit each and every object, feature, or advantage. It is contemplated that different embodiments may have different objects, features, or advantages.

According to one aspect, a method for designing an electronic device including at least one LED light source to reduce spillage of light from the at least one LED light source is provided. The method includes designing a housing, designing a printed circuit board for placement within the housing, positioning the at least one LED light source on the printed circuit board, and positioning a plurality of electronic components around the at least one LED light source on the printed circuit board to reduce spillage of the light from the at least one LED light source. The electronic device may be an in-ear device and the housing may be an ear piece housing. The electronic components may be of various types.

According, to another aspect, an electronic device is provided. The electronic device includes a housing, a printed circuit board disposed within the housing, at least one LED light source mounted to the printed circuit board, and a plurality of electronic components positioned around the at least one LED light source to block light from the at least one LED light source and reduce spillage. The electronic device may be an in-ear device and the housing may be an ear piece housing. The device may further include a light guide in operative communication with the at least one LED light source. The electronic components may be of various types.

DETAILED DESCRIPTION

A novel approach to the prevention of side spillage from the LED light source is accomplished through the buildup of the electronic components of the device to effectively block such side spillage. This novel technique allows the minimum necessary components of the structure to be used. At the same time, the invention allows for blockage of the scattered segments emitted from the LED source not useful for device control functions in an economical fashion. Further, it allows for the electronics package to take maximal use of the limited available space. It has a further advantage of maintaining the lightest weight possible through the use of already required component sets.

Figure 1:
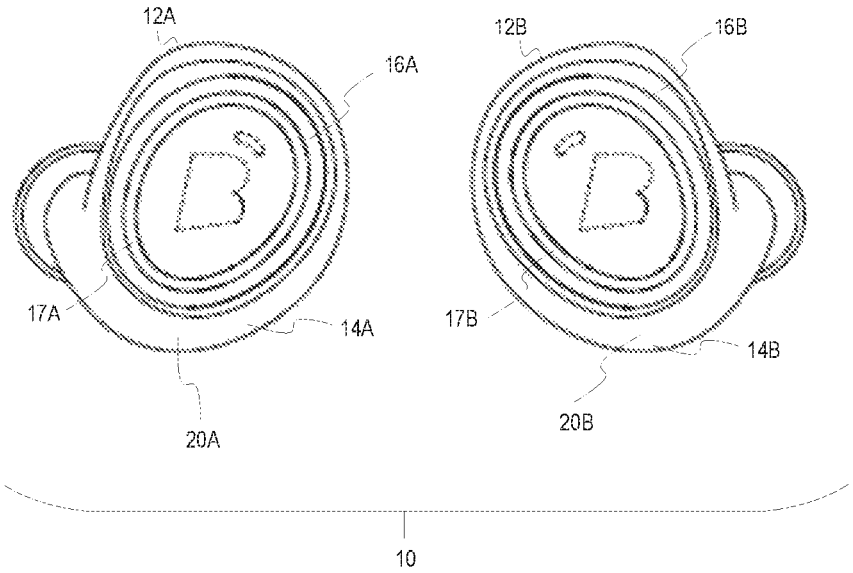
FIG. 1 is a perspective view of one embodiment of a wearable device.

FIG. 1 illustrates one example of an electronic device in the form of a wearable or personal area device in the form of a set of in-ear ear pieces 10 including a first earpiece 12A and a second ear piece 12B. The earpiece may be used in multiple modalities. The device may provide multiple functions including functions of interest to a user performing sports activities, the transmission of audio information for two way conversations, and the measurement of numerous biometric data sets. Of course, the earpiece may also perform additional functions.

Although such a device preferably performs a number of different functions, it is preferred that the wearable or personal area device be relatively simple and/or intuitive in operation. In addition, because the device may be used during sports activities it is preferred that the device be water resistant or otherwise adapted for harsh environments. Where the device is water resistant, it is preferred that the device allows the user to interact with it when in the water such as a swimming pool, lake, or ocean.

It should thus be appreciated that where the device is an ear piece, the single small device preferably performs numerous functions. One way in which the device may communicate with users is through the use of colorimetric light is used to give visual data and/or feedback to the user. The device may provide the user feedback over operational controls of the device, activate optional features, confirm gestural movements, allow for assessment of embedded device data such as device build, serial number, build date, etc. as well as to provide for an alternative method for software upload, download and analysis of data, and diagnostic purposes. It is the use of these LEDs used to produce the colorimetric light which may be create LED spillage.

FIG. 1 illustrates one example of a wearable device in the form of a set of earpieces 10 including a left ear piece 12A and a right earpiece 12B. Each of the ear pieces 12A, 12B has a housing 14A, 14B which may be in the form of a protective shell or casing and may be an in-the-ear earpiece housing. A light display area 16A, 16B is present on each of the ear pieces 12A, 12B. The light display areas 16A, 16B each provide for producing light of one or more colors. One or more LED(s) 20A, 20B may be positioned within the ear pieces 12A, 12B in order to generate light which is piped or otherwise communicated via light guides 17A, 17B to the light display areas 16A, 16B.

Figure 2:
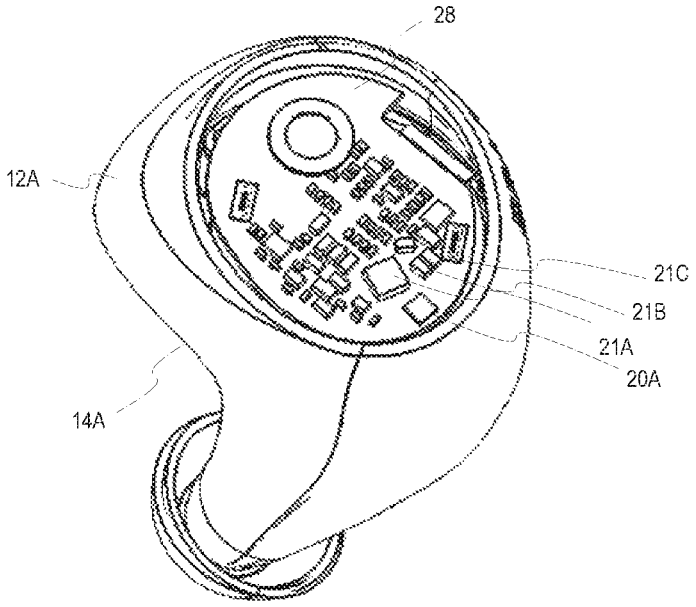
FIG. 2 is another view of a wearable device.

FIG. 2 illustrates an ear piece 12A with a housing 14A with a portion of the housing 14A removed to show a printed circuit board 30. One or more LED(s) 20A may be mounted to the printed circuit board 28. In use, light emitted from the one or more LED(s) 20A may spill into the device. However, placement of a plurality of electronic components 21A, 21B, 21C around the one or more LED(s) 20A results in reducing the light spillage. The electronic components may include various types of electronic components of various package sizes.

Figure 3:
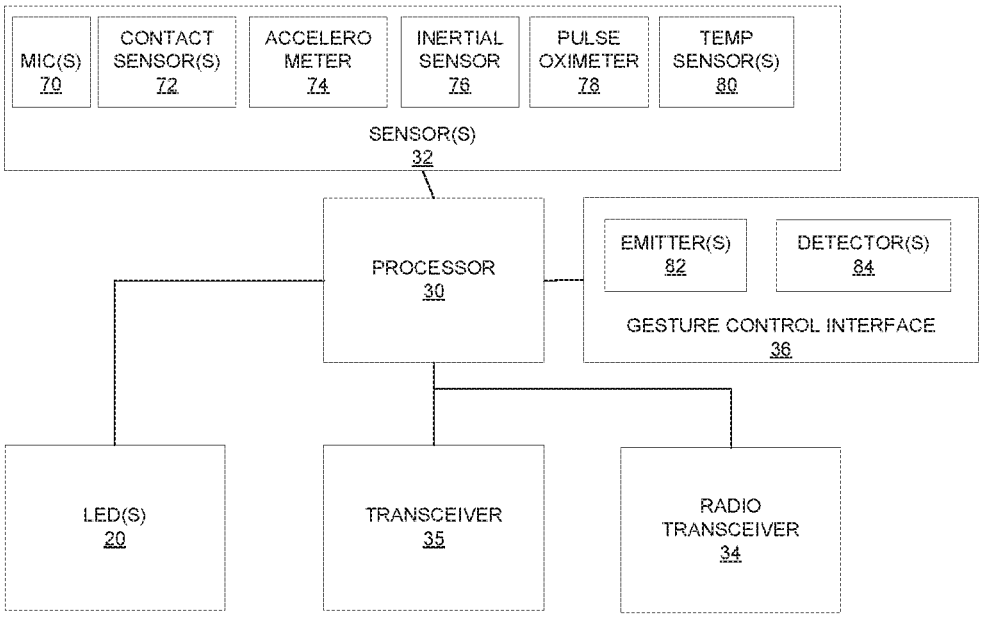
FIG. 3 is a block diagram of a device.

FIG. 3 is a block diagram illustrating a device. The device may include one or more LEDs 20 electrically connected to a processor 30. The processor 30 may also be electrically connected to one or more sensors 32. Where the device is an earpiece, the sensor(s) may include an inertial sensor 76, an accelerometer 74, one or more contact sensors 72, a bone conduction microphone or air conduction microphone 70, a pulse oximeter 76, a temperature sensor 80, or other biological sensors. A gesture control interface 36 is also operatively connected to the processor 30. The gesture control interface 36 may include one or more emitters 82 and one or more detectors 84 for sensing user gestures. The emitters 82 may be of any number of types including infrared LEDs. The device may include a transceiver 35 which may allow for induction transmissions such as through near field magnetic induction. A short range transceiver 34 using BLUETOOTH, Ultra-wideband (UWB), or other means of radio communication may also be present. In operation, the processor 30 may be programmed to convey different information using one or more of the LED(s) 20 based on context or mode of operation of the device. The various sensors 32, the processor 30, and other electronic components may be located on the printed circuit board of the device.

Figure 4:
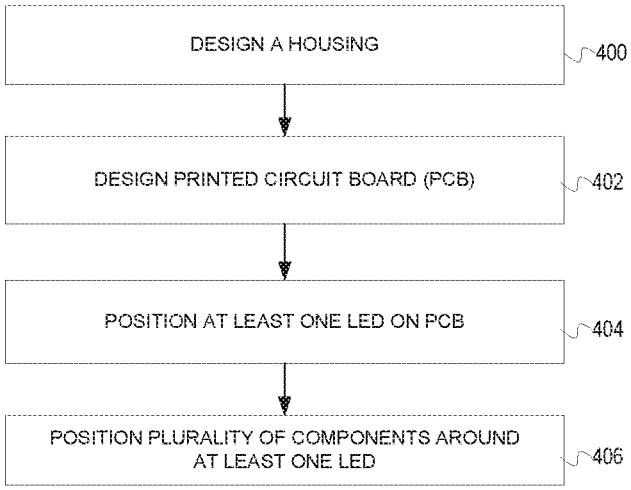
FIG. 4 illustrates a method.

FIG. 4 illustrates one example of a method. Although various steps are shown and described with respect to the design process, it is to be understood that the steps may occur in different orders and that the design process is iterative in nature. As shown in FIG. 4, in step 400 a housing is designed. In one example, the housing is designed to be an ear piece housing for an in-ear device. In step 402, a printed circuit board is designed for placement within the housing. In step 404, at least one LED light source is positioned on the printed circuit board. In step 406, a plurality of electronic components are positioned around the at least one LED light source on the printed circuit board to reduce spillage of the light from the at least one LED light source.

Therefore, various examples of systems, devices, apparatus, and methods for preventing LED light spillage. Although various embodiments and examples have been set forth, the present invention contemplates numerous variations, options, and alternatives.

What is claimed is:

1. A method for producing an in-ear device including at least one LED light source to reduce spillage of light from the at least one LED light source, the method comprising:

providing an earpiece housing;

providing a printed circuit board for placement within the earpiece housing;

positioning the at least one LED light source on the printed circuit board proximate to a side of the earpiece housing to reduce the spillage of the light toward a central area of the in-ear device from the at least one LED light source; and positioning a plurality of electronic components around the at least one LED light source on the printed circuit board to reduce the spillage of the light toward the central area of the in-ear device from the at least one LED light source; and providing a processor disposed of within the earpiece housing and configured to communicate information to a user through a light display of the in-ear device using the at least one LED light source.

2. The method of claim 1 wherein the plurality of the electronic components around the at least one LED light source on the printed circuit board include an inertial sensor and a microphone.

3. The method of claim 1 further comprising positioning a light guide in operative communication with the at least one LED light source.

4. An in-ear device, comprising:

an earpiece housing;

a printed circuit board disposed within the earpiece housing;

at least one LED light source mounted to the printed circuit board proximate to a side of the earpiece housing to block light and reduce spillage toward a central area of the in-ear device from the at least one LED light source;

a plurality of electronic components positioned around the at least one LED light source to block the light from the at least one LED light source and reduce the spillage toward the central area of the in-ear device; and a processor disposed of within the earpiece housing and configured to communicate information to a user through a light display of the in-ear device using the at least one LED light source.

5. The in-ear device of claim 4 wherein the plurality of electronic components include an inertial sensor and a microphone.

6. The in-ear device of claim 5 wherein the in-ear device further comprises a light guide in operative communication with the at least one LED light source.

* * * * *